United States Patent [19]

Rump

[11] 4,141,507

[45] Feb. 27, 1979

[54] LIQUID DISCHARGE NOZZLE WITH FLOW DIVIDER

[75] Inventor: Martin Rump, Bergisch Gladbach, Fed. Rep. of Germany

[73] Assignee: Dietz Armaturen GmbH, Bergisch-Gladbach, Fed. Rep. of Germany

[21] Appl. No.: 790,741

[22] Filed: Apr. 25, 1977

[30] Foreign Application Priority Data

May 3, 1976 [DE] Fed. Rep. of Germany ..... 2619415

[51] Int. Cl.[2] ..... B05B 1/04

[52] U.S. Cl. ..... 239/590.5; 239/592; 239/597

[58] Field of Search ..... 239/590–594, 239/597, 600–602, DIG. 19

[56] References Cited

U.S. PATENT DOCUMENTS

| | | | |
|---|---|---|---|
| 1,496,635 | 6/1924 | Highley | 239/594 |
| 3,041,748 | 7/1962 | Wetzel | 239/592 |
| 3,831,859 | 8/1974 | Allard | 239/592 |
| 4,035,870 | 7/1977 | Reba et al. | 239/592 X |
| 4,043,397 | 8/1977 | Glowienke | 239/592 X |

FOREIGN PATENT DOCUMENTS

| | | | |
|---|---|---|---|
| 6929123 | 11/1969 | Fed. Rep. of Germany | 239/593 |
| 1658244 | 9/1970 | Fed. Rep. of Germany | 239/593 |
| 2252754 | 5/1973 | Fed. Rep. of Germany | 239/591 |

*Primary Examiner*—Robert B. Reeves
*Assistant Examiner*—Andres Kashnikow
*Attorney, Agent, or Firm*—Spencer & Kaye

[57] ABSTRACT

A nozzle for forming a liquid jet includes a flow passage having a circular inlet and a flat rectangular outlet and a cross section which gradually changes from a circular shape to a flat rectangular shape. The magnitude of the cross-sectional area of the flow passage gradually decreases in the flow direction of the liquid. The flow passage changes direction in a zone at the upstream beginning of the change of cross-sectional shape to assume a new direction which is at an acute angle of deflection to the original direction of the flow passage. The long sides of the rectangular cross section of the flow passage are perpendicular to a first imaginary plane containing both legs of the angle of deflection. The nozzle is formed of a first and a second nozzle part having, respectively, first and second edge faces. The nozzle parts are joined to one another by a face-to-face engagement between the edge faces. The latter extend throughout the entire length of the nozzle and are perpendicular to the first imaginary plane. The edge faces lie in a second imaginary plane halving the flow passage along the entire nozzle length. The nozzle further has a flow divider supported in the flow passage and extending in the zone where the flow passage changes direction.

14 Claims, 6 Drawing Figures

35
3
1
II
5
12
R2
α
4
6
8
11
R1
9
10
r3
19
23
2
r4
20
II
VI
29
33
31
32
30
12
34
VI
29
31
32
12
30
33
34
8
26
27
9
11
r5
21
24
18
1
14
15
16
7
17
2
13
25
28
12
31-34
31-34
V
V
28
r6
22

LIQUID DISCHARGE NOZZLE WITH FLOW DIVIDER

BACKGROUND OF THE INVENTION

This invention relates to a nozzle for forming a liquid jet, particularly a water jet and is of the type in which a deflection of the flow direction of the liquid is effected in an acute angle with respect to the original flow direction and further, in which the boundaries of the flow passage cross section change, in the flow direction, from a circular shape to a rectangular configuration. The deflection of the flow direction is effected in the nozzle in a zone where the flow passage cross section starts its transformation from a circular form into a rectangular form. Further, the long sides of the rectangular flow passage cross section extend perpendicularly to a plane containing the legs of the acute deflecting angle and also, the flow passage cross section is gradually reduced in the direction of the discharge opening.

A nozzle of the above-outlined type which is disclosed, for example, in German Utility Model No. 6,929,123, has the purpose of forming a liquid jet having as closed a configuration as possible. Stated differently, it is a desideratum that the liquid jet, as its distance from the discharge opening of the nozzle increases (that is, as the liquid travels in free air), widens (scatters) as little as possible. To achieve this object, it has been proposed to "kink" the nozzle with respect to the liquid inlet in such a manner that the acute angle formed by the median inflow direction and the median outflow direction is approximately 45°. Further in accordance with the prior art structure, the lateral guide walls are divergent in the direction of the discharge opening with respect to the median direction of discharge. The angle of divergence on each side of the discharge opening is such that the contraction of the liquid jet normally occurring downstream of the discharge opening in case of parallel lateral guide walls is entirely or substantially compensated. The anticipated effect of this prior art structure was that by virtue of the deflection of the liquid jet downstream of the inlet a receiving chamber is obtained in the nozzle and that the liquid first accumulates and steadies itself in the receiving chamber, and thereafter the outlet cross section is filled by the flowing liquid in a substantially uniform manner.

In prior art structures, the deflection of the liquid flow in an acute angle in the nozzle has been given great significance, particularly regarding the outflow cross section effected by the transformation of the flow passage cross section of the nozzle.

The experience with the prior art structures indicates that the desired effects have been largely accomplished.

SUMMARY OF THE INVENTION

It is an object of the invention to provide an improved nozzle of the above-outlined type which further ameliorates the effects of prior art structures.

This object and others to become apparent as the specification progresses, are accomplished by the invention, according to which, briefly stated, the nozzle is formed of two parts joined to one another by means of edge faces that are perpendicular to an imaginary plane containing both legs of the deflection angle $\alpha$. The edge faces extend throughout the entire length of the nozzle and define an imaginary plane which halves the entire flow path of the nozzle. Further, a flow divider is supported inside the nozzle in the zone where the flow passage changes its direction.

The above-outlined flow divider has the advantageous effect that the liquid flow is, at a location where it is forced to change direction within the nozzle, that is, at a location where the flow passage cross section begins its transition from a circular shape to a rectangular shape, stabilized to a substantial extent and, as a result, it remains in close contact with the inner wall portions of the nozzle.

A substantially laminar flow of the liquid at the inner wall portions of the nozzle is of decisive significance concerning the behavior of the liquid discharged by the nozzle into free air, where the liquid jet is no longer guided at all sides. The air which, contrary to a solid body, is a flowable medium, has the propensity to enter into turbulance with the liquid as soon as the latter leaves the nozzle. This effect is largely suppressed by the division of the nozzle effected according to the invention.

The division of the nozzle lengthwise at least along one portion establishes the precondition that the liquid jet exiting from the nozzle behaves in free air in a stable manner for a greater length than has been possible with prior art devices; that is, it does not generate a turbulance with air at a point in space (and time) as early as has been the case in the prior art structures. The division of the nozzle along its entire length provides the possiblity to readily install the flow divider. The prime significance, however, is the possibility to form the inner walls of the nozzle in a hydrodynamically favorable manner which in the one-piece nozzles of the prior art has not been possible. The known nozzle, in view of its one-piece structure, has to be manufactured by a casting process with the necessary consequence that the inner wall portions of the nozzle cannot be submitted to a finishing operation to smoothen their surfaces. The invention provides the significant advantage that the inner wall parts of the nozzle may be machined smooth not only along their planar faces, but also at locations where the inner faces are arcuate and advantageously even at those locations where a deflection of the liquid stream takes place.

Thus, the invention makes possible to utilize for the manufacture of both parts of the nozzle other manufacturing methods, known by themselves, for ensuring the best surface quality of the inner faces. Such manufacturing methods are, for example, forging, injection molding, press molding, or drop forging. Such manufacturing methods have, as compared to the casting method, the significant advantage that shrink holes or sand pockets cannot occur. This is of particular significance for the additional machining of both the inner faces and the outer faces of the nozzle parts. In the manufacture of cast nozzles which, for aesthetic considerations, are externally chromed and therefore, prior to chroming, have to be externally ground, a great number of rejects have been generated because, very often, during the grounding operation shrink hloes and sand pockets have been torn open. This significant disadvantage is eliminated by dividing the nozzle according to the invention.

The smooth upper surface properties of all the inner faces of the nozzle may be ameliorated according to the invention, by providing a lime rejecting coating. Accordingly, the flow divider may also be provided with a hydrodynamically favorable coating.

At those locations inside the nozzle where the earlier-discussed cross-sectional change takes place, it is of advantage to provide, for a stabilization of the liquid flow in that zone, that adjacent the flow divider, the inner radii of the curvature of both nozzle parts are larger than the associated passage width measured parallel to the parting plane of the nozzle.

In order to obtain a stable flow of the liquid within the nozzle, according to a further feature of the invention the cross section of the discharge opening has an area of about 80% of that of the nozzle inlet. Preferably, the reduction of the flow passage cross section of the nozzle has a linear characteristic.

According to a further feature of the invention - which serves to affect the liquid flow prior to its entering the free air - the discharge opening is formed by a "mouthpiece" in which the oppositely located bounding surfaces are parallel and perpendicular, respectively, to one another. The mouthpiece, for the purpose of achieving a smooth, free transition of the liquid flow therein, adjoins the walls of the nozzle at all sides with hydrodynamically favorable radii. The depth (measured in the flow direction) of the mouthpiece should be approximately 5-6 times larger than the height (measured perpendicularly to the parting plane of the nozzle) of the outlet cross section of the mouthpiece.

The flow divider forming part of the invention is secured between the nozzle parts. For this purpose it is sufficient to provide the flow divider with lateral tabs which may be received in corresponding depressions of the dividing faces of the nozzle before permanently joining the nozzle parts to one another. It is feasible, however, to secure the flow divider along its entire length between the nozzle parts. The connection between the nozzle parts may be effected by any suitable known means such as by screw connection, soft soldering, hard soldering, welding or gluing. During the permanent joining operation performed on the two nozzle parts care has to be taken merely to ensure that inside the nozzle no burr or the like is formed along the parting line.

The flow divider constitutes, inside the nozzle, a structural element shaped to be oriented in the direction of the liquid flow. According to the invention, with the flow divider additional flow dividers may be associated; they may be arranged at either side of the principal flow divider at a distance therefrom. The additional flow dividers may be connected with one another by means of webs oriented in the direction of liquid flow. In case only a single flow divider is provided, at both sides thereof there may be provided guiding ribs which are oriented in the flow direction and which may extend up to the oppositely located wall protion of the nozzle.

In German Laid-Open Application (Offenlegungsschrift) No. 1,658,244 there is disclosed a nozzle which, as set forth in the last paragraph of the specification, is made expediently of non-rusting material such as brass, chrome-nickel steel or synthetic material and that the individual parts may be secured to one another by welding. A division of nozzle into only two components which are in engagement with one another along surface portions lying in an imaginary plane which divides the flow path along the entire length of the nozzle, however, is a novel contribution of the invention.

Similar considerations are deemed to apply with regard to the arrangement disclosed in United States Pat. No. 1,496,635.

DESCRIPTION OF THE PREFERRED EMBODIMENT

Figures 1, 2, 3, 4, 5, 6:
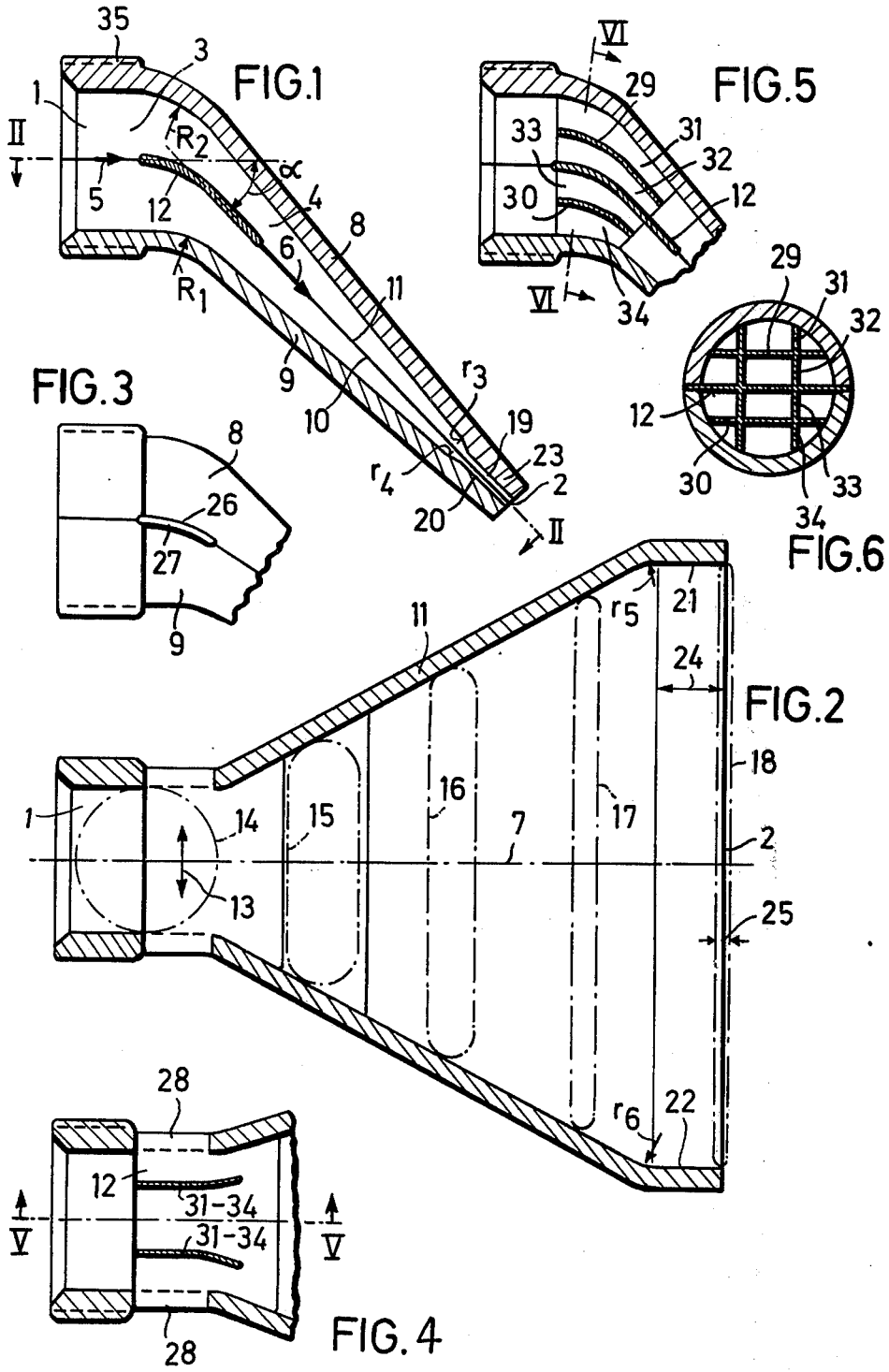
FIG. 1 is a longitudinal sectional view of a preferred embodiment of the invention.
FIG. 2 is a sectional view taken along line II—II of FIG. 1.
FIG. 3 is a fragmentary external view of one portion (inlet portion) of the structure of FIG. 1.
FIG. 4 is a sectional view of one portion (inlet portion) of the structure of FIG. 2 modified by additional flow dividers.
FIG. 5 is a sectional view taken along line V—V of FIG. 4.
FIG. 6 is a sectional view taken along line VI—VI of FIG. 5.

Turning now to FIGS. 1 and 2, the nozzle illustrated therein and structured according to a preferred embodiment of the invention has a liquid inlet 1 of circular cross section and aliquid outlet (discharge opening) 2 of flat rectangular cross section. In the inside of the nozzle, from a location 3 to a location 4 there is effected a deflection of the liquid flow from the original direction 5 to a new direction 6 at an acute angle $\alpha$. Further, in the zone of the deflection there is effected a transition of the flow passage cross section from a circular outline as at 1 to a rectangular outline as at 4. The magnitude of the cross-sectional area of the flow passage gradually decreases towards the discharge opening 2. The long sides of the rectangular flow passage section extend perpendicularly with respect to a plane 7 containing both legs (extending in the flow directions 5 and 6 respectively) of the deflection angle $\alpha$. The plane 7 extdends perpendicularly to the drawing plane of FIG. 2 and constitutes the symmetry plane of the nozzle.

According to the invention, the nozzle is formed of two joined parts 8 and 9 which engage one another with respective edge faces 10 and 11 which, in turn, are oriented perpendicularly to the symmetry plane 7. In the illustrated embodiment both faces 10 and 11 define an imaginary plane which divides the flow path into two halves over the entire length of the nozzle. It is to be understood that the division of the nozzle into two parts may be different from the above-described division without departing from the invention.

In the zone of the deflection of the flow direction there is provided, inside the nozzle, a flow divider 12 constituted by a structural element shaped to be oriented in the flow direction. The flow divider 12 halves, to a certain extent, the flow passage cross section at the location where it is arranged, that is, at a location where the liquid flow is deflected within the nozzle. It was found to be particularly advantageous from the hydrodynamic point of view to so design the inner radii of curvature $R_1$ and $R_2$ of the components 9 and 8, respectively, at opposite sides of the flow divider that they are larger than the associated passage width measured parallel to the parting plane II—II (FIG. 1) of the nozzle. Thus, the channel widths in question are at a location where the double-headed arrow 13 is drawn in FIG. 2.

In FIG. 2 the different passage cross sections along the flow path are shown in dash-dot lines. It is thus seen that starting at the liquid inlet 1, the cross section bounded by a circle 14 is transformed into a rectangular cross section in which the narrow sides of the rectangle are of rounded configuration. The rectangles representing the cross-sectional boundaries are designated at 15, 16, 17 and 18. The area of the cross section 18 constituting the discharge outlet 2 of the nozzle is approximately 80% of the area of the cross section 14 constituting the nozzle inlet 1. The decrease of the cross-sectional area has an approximately linear characteristic.

The discharge opening 2 of the nozzle is shaped as a "mouthpiece" in which the oppositely located bounding faces 19, 20 (FIG. 1) and, respectively, 21, 22 (FIG. 2) extend parallel and perpendicularly to one another. The bounding faces 21 and 22 merge rounded into the bounding faces 19 and 20. Internally, the nozzle mouthpiece 23, defined by the faces 19–22, joins the nozzle walls at all sides with hydrodynamically favorable radii $r_3$–$r_6$. The depth 24 (measured in the flow direction) of the mouthpiece 23 is approximately 5–6 times larger than the height 25 (measured perpendicularly to the parting plane II—II) of the discharge opening 2.

The flow divider 12 is secured to the nozzle by clamping it between the nozzle components 8 and 9 as particularly well seen in FIG. 3. The parts 8 and 9 have, in the zone of the flow divider 12, cutouts 26 and 27 into which project laterally extending tabs 28 of the flow divider 12 as may be observed in FIG. 4. The tabs 28 extend only along one part of the length of the flow divider 12. As an alternative, it is feasible to so dimension the cutouts in the nozzle components 8 and 9 that the flow divider 12 can be arranged along its entire length in the nozzle cutouts. The nozzle parts 8 and 9 and the flow divider 12 form, subsequent to permanently joining the nozzle parts to one another, an outwardly fluidtight unit.

Turning now to FIGS. 5 and 6, the flow divider 12 may be provided with additional flow dividers 29 and 30 which extend at both sides of the principal flow divider 12 at a distance therefrom. As further seen in FIG. 5, the additional flow dividers 29 and 30 need not have the same length as the flow divider 12. The additional flow dividers 29 and 30 are connected to one another by webs 31, 32, 33 and 34 oriented in the direction of the liquid flow.

A modification of the embodiments shown in FIGS. 4, 5 and 6 with regard to the flow dividers and webs is feasible in accordance with the invention by omitting the additional flow dividers 29 and 30. In such a case the webs 31–34 are provided on the flow divider 12 as guide ribs which extend up to the oppositely located inner wall portion of the nozzle. (it is noted that even in the presence of the additional flow dividers 29, 30 the webs 31–34 function as guide ribs.)

The inner surfaces of the nozzle are treated particularly in the zone where the deflection of the liquid takes place, to ensure a loss-free flow to an extent possible. All inner surfaces of the nozzle are preferably treated to ensure properties of a smooth surface. A preferred treatment for the amelioration of surface properties according to the invention comprises the application of a lime resistant layer consisting of a material known by itself. The flow divider too, may be provided with a coating ensuring a hydrodynamically favorable shape. This may be realized by a varnish based on synthetic resins, a zapon varnish or the like. The layer or coating is applied by splashing or spraying, for example, after connecting all parts together by gluing, welding or soldering.

As may be observed in FIGS. 1–5, the nozzle is, in the zone of the inlet 1, provided with an outer thread 35 for attachment to a hose or similar conduit. It is expedient to effect such connection with the intermediary of a flow conducting joint.

A nozzle described above may be advantageously used in sauna baths for the water-cooling of the heated sauna chamber after use. It is noted, however, that the invention may find application in any environment where the generation of a flat, form-retaining liquid jet is desirable.

It will be understood that the above description of the present invention is susceptible to various modifications, changes and adaptations, and the same are intended to be comprehended within the meaning and range of equivalents of the appended claims.

What is claimed is:

1. In a nozzle for forming a liquid jet, including a flow passage having a circular inlet and a flat rectangular outlet; the cross section of the flow passage gradually changing from a circular shape to a flat rectangular shape; the magnitude of the cross-sectional area of the flow passage gradually decreasing in the flow direction of the liquid; the flow passage changing direction in a zone at the upstream beginning of the change of cross-sectional shape to assume a new direction being at an acute angle of deflection to an original direction of the flow passage; the long sides of the rectangular cross section of the flow passage being perpendicular to a first imaginary plane containing both legs of the angle of deflection; wherein the nozzle has a first and a second nozzle part having, respectively, first and second edge faces; the nozzle parts being joined to one another by a face-to-face engagement between said first and second edge faces; said edge faces extending throughout the entire length of the nozzle and being perpendicular to said first imaginary plane; said edge faces lying in a second imaginary plane halving said flow passage along the entire length of the nozzle; the improvement comprising a flow divider supported in said flow passage and extending in said zone and wherein said flow divider changes direction for following the course of directional change of said flow passage and wherein said flow divider is clamped between said first and second nozzle parts.

2. A nozzle as defined in claim 1, wherein said zone has a shape and surface properties effecting a low-loss liquid flow therein.

3. A nozzle as defined in clam 1, wherein all inner faces bounding said flow passage are provided with a lime resistant coating.

4. A nozzle as defined in claim 1, wherein said flow divider has a coating for providing said flow divider with a hydrodynamically favorable shape.

5. A nozzle as defined in claim 1, wherein each nozzle part has a radius of curvature for changing the course of the flow passage from said original direction to said new direction; each radius of curvature being larger than the width of the flow passage in said zone; said width being measured in a direction parallel to said second imaginary zone.

6. A nozzle as defined in claim 1, wherein the cross-sectional area of said flat rectangular outlet is approximately 80% of that of said circular inlet.

7. A nozzle as defined in claim 1, wherein the cross-sectional area of the rectangular flow passage section decreases approximately as a linear function.

8. A nozzle as defined in claim 1, wherein said flat rectangulr outlet is formed by a nozzle mouthpiece having four internal bounding wall faces arranged in mutually parallel and perpendicular pairs.

9. A nozzle as defined in claim 8, wherein each said bounding wall face adjoins inner, upstream walls of said nozzle with a hydrodynamically favorable radius.

10. A nozzle as defined in claim 8, wherein the depth of said mouthpiece measured in said new direction is about five to six times larger than the height of said outlet opening measured perpendicularly to said second imaginary plane.

11. A nozzle as defined in claim 1, wherein said flow divider constitutes a principal flow divider; further comprising additional flow dividers supported at opposite sides of said principal flow divider and extending at a distance therefrom.

12. A nozzle as defined in claim 11, further comprising webs connecting said additional flow dividers and extending in the flow direction defined by said flow passage.

13. A nozzle as defined in claim 1, further comprising flow guiding ribs attached to opposite sides of the flow divider and extending in the flow direction defined by said flow passage; said guiding ribs extending from said flow divider to adjacent inner wall faces bounding said flow passage.

14. A nozzle as defined in claim 1, wherein said flow divider has oppositely extending tab portions; at least one of said nozzle parts being provided with cutouts in said edge faces for receiving said tab portions, said flow divider being supported by clamping said tab porions between said first and second nozzle parts.

* * * * *